United States Patent [19]

McLain et al.

[11] 4,085,574

[45] Apr. 25, 1978

[54] APPARATUS FOR AUTOMATICALLY ANCHORING, TWISTING AND WINDING FILAMENT, OR THE LIKE, ONTO A SPOOL

[75] Inventors: Philippe Hardy-Thé McLain, Columbia; Bob Gene Shepherd, West Columbia, both of S.C.

[73] Assignee: Shakespeare Company, Columbia, S.C.

[21] Appl. No.: 730,160

[22] Filed: Oct. 7, 1976

[51] Int. Cl.[2] ..... D01H 7/26; D01H 7/50

[52] U.S. Cl. ..... 57/68; 57/71; 57/115

[58] Field of Search ..... 57/34 PW, 68, 70, 71, 57/115; 242/18 PW

[56] References Cited

U.S. PATENT DOCUMENTS

| | | | |
|---|---|---|---|
| 886,698 | 5/1908 | Hardman | 57/71 X |
| 1,713,326 | 5/1929 | Borovay et al. | 57/115 X |
| 2,526,247 | 10/1950 | Lewis | 57/70 |
| 3,449,901 | 6/1969 | Mackie | 57/71 |

*Primary Examiner*—Richard C. Queisser
*Assistant Examiner*—Charles Gorenstein
*Attorney, Agent, or Firm*—Hamilton, Renner & Kenner

[57] ABSTRACT

Disclosed is a spooling apparatus that can be threaded on the fly to anchor, controllably twist and wind filament onto a receiving spool. A receiving spool is non-rotatably mounted on a spool shaft for axial reciprocation. A lead-in pulley, whose rotational axis is perpendicular to the receiving spool axis, is spaced axially outboard with respect to the receiving spool. A flier is mounted to rotate concentrically about the receiving spool and presents a pick-up head adapted to engage the feed run of the filament as it passes between the lead-in pulley and an orienting pulley located in proximity to the inboard end of the receiving spool. The orienting pulley is canted such that the tailing run of the filament cannot be engaged by the pick-up head as it rotates with the flier although the canting of the orienting pulley disposes the feed run such that it will be engaged by the rotating pick-up head when the spool reaches a predetermined position along its range of axial reciprocation. The feed run extends through a cutting mechanism which severs the tailing run therefrom shortly after the pick-up head engages the feed run. Means are provided to grip the severed end of the feed run after severance and until such time as it becomes anchored thereto by successive overwraps. Means are also provided to assure that the twist imparted to the filament by rotation of the flier about the receiving spool will be transmitted across the pick-up head with the filament as it is wound onto the spool.

7 Claims, 5 Drawing Figures

APPARATUS FOR AUTOMATICALLY ANCHORING, TWISTING AND WINDING FILAMENT, OR THE LIKE, ONTO A SPOOL

BACKGROUND OF THE INVENTION

In the spooling of filaments one or more strands of the finished product leave the manufacturing stage at a relatively high rate of speed to be wound onto appropriate receiving spools. Particularly in the situation where a plurality of ends are to be wound on individual spools the spooling is generally accomplished on a banked winding mechanism. A waste roll is provided substantially in line with, and beyond, the banked winding mechanism so that the filament ends not being spooled will not accumulate but will be removed from the area in which winding is accomplished in an orderly fashion, particularly prior to the time that the ends are anchored to the spools preparatory to being wound thereon. Removal of loose ends is particularly important when one appreciates that filament emanates from the source at speeds of up to approximately 800 feet per minute.

Historically, a workman would carefully select a particular end, whip a rolling hitch around the rotating spool on which it was to be wound in order to effect an anchor of the lead-in run to the spool and then quickly sever the tailing run so that the tail would continue to the waste roll while the feed run wound onto the rotating spool. Anchoring of the filament in this fashion requires considerable manual dexterity, and even workmen who have become relatively profficient are not always successful on the first attempt in effecting the required anchor of the feed run to the spool requisite to the winding operation, the difficulty of which is greatly compounded as a result of the speed at which the filament is travelling between the source and waste roll.

In addition, it should be appreciated that when filament is stripped axially from a non-rotatable spool, as it would be, for example, when contained in a canister of the type depicted in prior U.S. Pat. No. 3,502,281, a twist is imparted to the filament by the removal of each wrap. Although this twisting will exist with any filament, the affect thereof is considerably magnified when the cross-sectional configuration of the filament is such that the twist will not stay with the length of the filament in which it occurs but accumulates in a given length of filament adjacent the spool. This situation is epitomized when the filament is employed as a sewing thread, particularly if the configuration of the thread is such that the twist will not pass through the sewing machine. A hopeless snarl results which requires that the thread be severed, the twist removed, and the sewing machine re-threaded before continuing.

SUMMARY OF THE INVENTION

It is, therefore, one of the primary objects of the present invention to provide a filament winding apparatus in which a controlled twist is imparted to the filament as it is would onto a receiving spool — the imparted twist being equal and opposite to the twist that will be imparted when the filament is stripped axially from the spool so that the filament will be twist-free when used.

It is another object of the present invention to provide a filament twisting and winding apparatus, as above, which anchors the filament to the receiving spool.

It is yet another object of the present invention to provide a filament anchoring, twisting and winding apparatus, as above, on which the filament can be threaded successfully time and time again on the fly — i.e., without the need to reduce the speed at which the filament is travelling between its source and the waste roll — and without the need for any particular skills or acquired dexterity.

It is a further object of the present invention to provide a filament anchoring, twisting and winding apparatus, as above, that is relatively inexpensive to manufacture and maintain and which will provide a long life even under arduous use.

These and other objects, together with the advantages thereof over existing and prior art forms which will become apparent from the following specification, are accomplished by means hereinafter described and claimed.

In general, a filament anchoring, twisting and winding apparatus embodying the concept of the present invention mounts a receiving spool non-rotatably on a reciprocating shaft. A lead-in pulley is displaced axially outwardly with respect to the outboard flange of the receiving spool and is mounted to rotate about an axis that is disposed substantially transverse the axis of the receiving spool.

An orienting pulley is presented axially beyond the inboard flange of the receiving spool and is canted so that the feed run of filament passing from the lead-in pulley to the orienting pulley is disposed radially outwardly with respect to the tailing run of that same filament passing from the orienting pulley back to the lead-in pulley. The orienting pulley may conveniently be supported from the reciprocating shaft.

A pick-up head is carried on the flier of the winding mechanism to rotate concentrically outwardly of the receiving spool. By positioning the orienting pulley radially outwardly with respect to the axially displaced lead-in pulley, the feed run extending therebetween angularly diverges with respect to the axis of the receiving spool as the run extends from the lead-in pulley to the orienting pulley. By selecting the radial disposition of the orienting pulley with respect to the lead-in pulley in conjunction with the path of the pick-up head as it circumscribes the receiving spool, one can predetermine the axial disposition of the receiving spool at which the pick-up head engages the feed run of the filament in order to achieve a locking overwrap of the filament being wound thereon relatively quickly after initiating the winding process.

A cutting mechanism is located in proximity to the orienting pulley and is actuated by a striker presented from the flier to sever the tail and feed runs of filament, also relatively quickly after the winding process is initiated. A gripping means may be associated with the cutting mechanism to grasp the severed end of the feed run and maintain it at least until such time as an anchoring overlap is achieved. The use of the gripping means obviates the criticality in the sequential timing of the anchoring and severing steps.

One twist of the filament per wrap onto the receiving spool is achieved by rotating the pick-up head about the non-rotating receiving spool while directing the feed run to the pick-up head from a position displaced axially with respect to the pick-up head.

In order to prevent the successive twists imparted to the filament during the winding operation from accumulating in that run of the filament between the source and the lead-in pulley, some means is provided to prevent the twist from passing across the lead-in pulley. According to one embodiment this result can be accomplished by taking one complete turn of the filament around the lead-in pulley and according to an alternative arrangement the line can pass between pinch rolls.

One preferred embodiment of the subject apparatus, together with an alternative lead-in pulley arrangement, are shown by way of example in the accompanying drawings and are described in detail without attempting to show all of the various forms and modifications in which the invention might be embodied; the invention being measured by the appended claims and not by the details of the specification.

DESCRIPTION OF THE PREFERRED EMBODIMENTS

Figure 1:
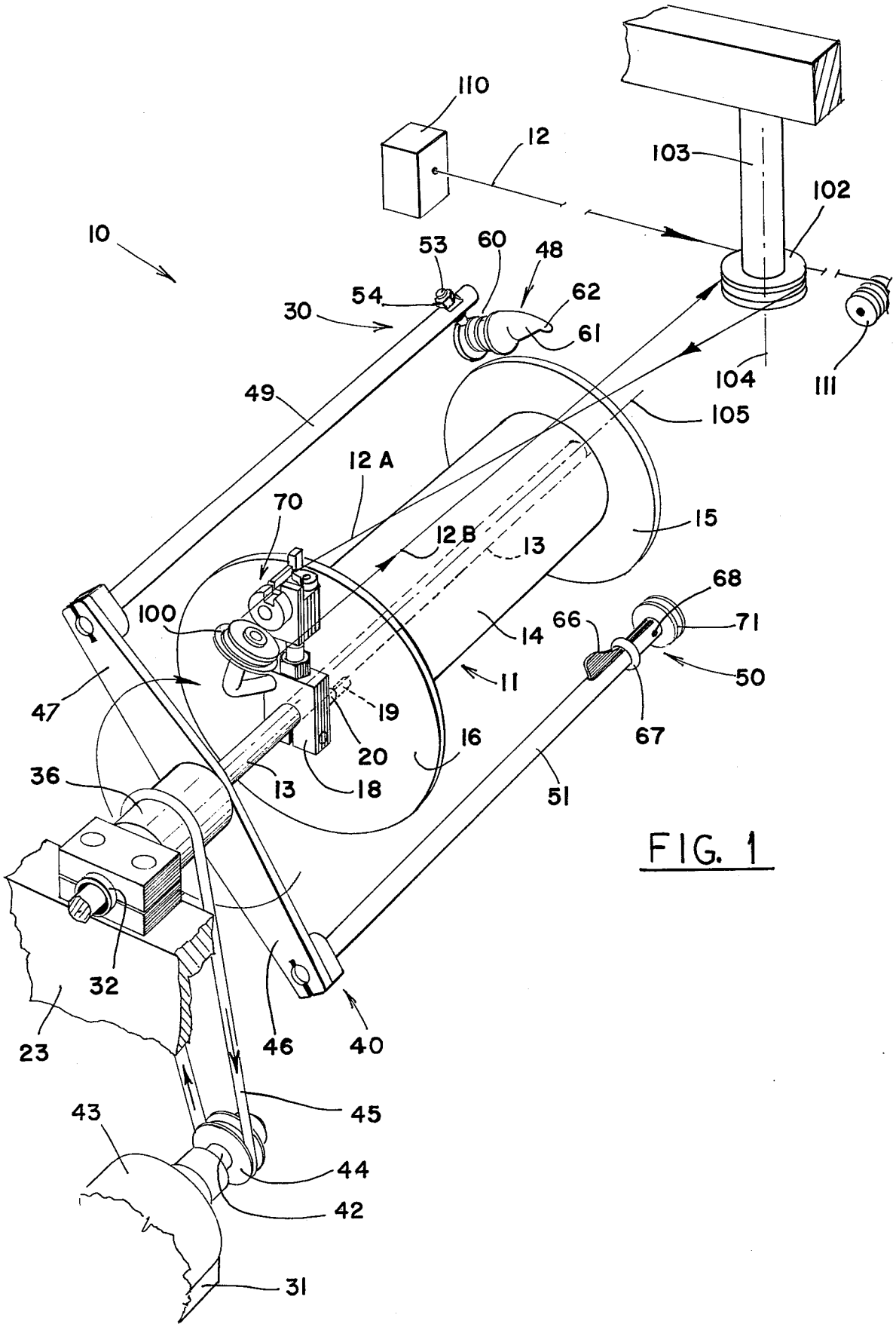
FIG. 1 is a perspective view of apparatus to anchor, twist and wind filament according to the concept of the present invention which depicts the feed run of the filament as it passes from its source around the lead-in pulley and to the orienting pulley as well as the tail run of that same filament as it returns from the orienting pulley, passes around the lead-in pulley and extends onto the waste roll.

A preferred embodiment of apparatus for anchoring, twisting and winding filament is indicated generally by the numeral 10 on the attached drawings.

A receiving spool 11 onto which the filament 12 is to be wound is removably and non-rotatably mounted on a spool shaft 13. The receiving spool 11 is typically formed with a core 14 of generally cylindrical cross-section which axially separates a pair of circular end flanges 15 and 16.

A locating stop block 18 is fixedly secured to the spool shaft 13 and may present a lug 19 that matingly engages a recess 20 extending axially into the core 14 in proximity to the inboard flange 16 to preclude rotation of the spool 11 on the spool shaft 13. A spring biased detent 21 extends radially from the spool shaft 13 to engage the axially outer surface 22 common to both the core 14 and the outboard end flange 15 when the lug 19 is received in recess 20, thereby releasably securing the spool 11 non-rotatably to the spool shaft 13.

That portion of the spool shaft 13 which supports the spool 11, and the locating block 18, extends in cantilevered fashion outwardly from a pedestal 23 in which it is supported for axial reciprocation by sleeve bearings 24 and 25. A cross head 26 connected to the spool shaft 13 reciprocates the spool 11 at a speed coordinated with the hereinafter described winding mechanism, indicated generally by the numeral 30, employed by apparatus 10 in order to effect a level wind of the filament 12 onto the spool 11.

The pedestal 23 extends upwardly from a base (not shown) and presents a transverse, longitudinally oriented support cylinder 32 within which the sleeve bearings 24 and 25 are mounted in axially spaced relation to stabilize the cantilevered end of the spool shaft 13.

A pair of axially spaced journal bearings 34 and 35 are secured to the exterior of the support cylinder 32 rotatably to mount the hub 36 of a flier, identified generally by the numeral 40, and comprising a component of the winding mechanism 30. The hub 36 is provided with a recessed, annular pulley notch 41. The shaft 42 of a motor 43 supported on the frame 31 presents a pulley 44 that is aligned with notch 41 so that a belt 45 reeved between the pulley 44 and notch 41 will rotate the hub 36 in response to rotation of the motor shaft 42.

The flier 40 also incorporates opposed spacer arms 46 and 47 that extend radially outwardly from diametrically opposite sides of the hub 36. A positioning rod extends transversely outwardly from the outermost portion of each spacer arm to be disposed generally parallel with the spool shaft 13. A thread-engaging, pick-up and turning head 48 is carried on positioning rod 49 which extends outwardly from spacer arm 47, and a counterweight/striker combination 50 is carried on the second of the positioning rods 51 which extends outwardly from spacer arm 46.

Figure 4:
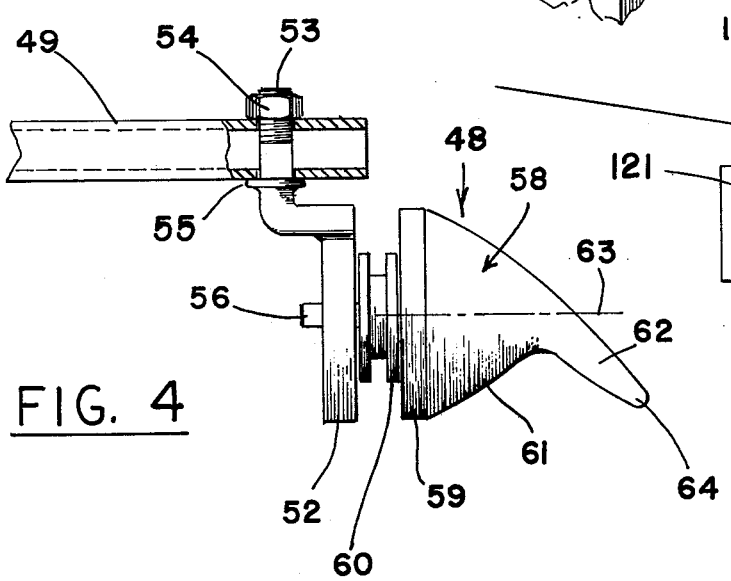
FIG. 4 is an enlarged side elevation, partly broken away, of the pick-up and turning head mounted on the flier; and, FIG. 5 is a top plan of an alternate form of lead-in pulley.

As best seen in FIG. 4, the pick-up and turning head 48 has a cylindrical mounting plate 52 that is fixedly secured to the positioning rod 49, as by a threaded stud 53 which pierces the rod 49 and is secured thereto by a nut 54 which tightens the rod 49 against shoulder 55 on stud 53. Mounted with its center aligned with that of the cylindrical plate 52, as by a spacer pin 56, is a thread catcher 58, the base 59 of which is disposed in parallel, spaced relation with respect to plate 52. A turning sheave 60, the operation of which will hereinafter be more fully apparent, is rotatably journaled on the spacer pin 56 between the plate 52 and the base 59 of thread catcher 58.

One configuration for the thread catcher 58 that works particularly well comprises a conical section 61 which extends outwardly from the base 59 and terminates in a cylindrical finger portion 62 which projects obliquely from the axis 63 of the conical section 61 at approximately 45°. The outer extremity of the finger portion 62 presents a semi-spherical terminus 64.

Figure 2:
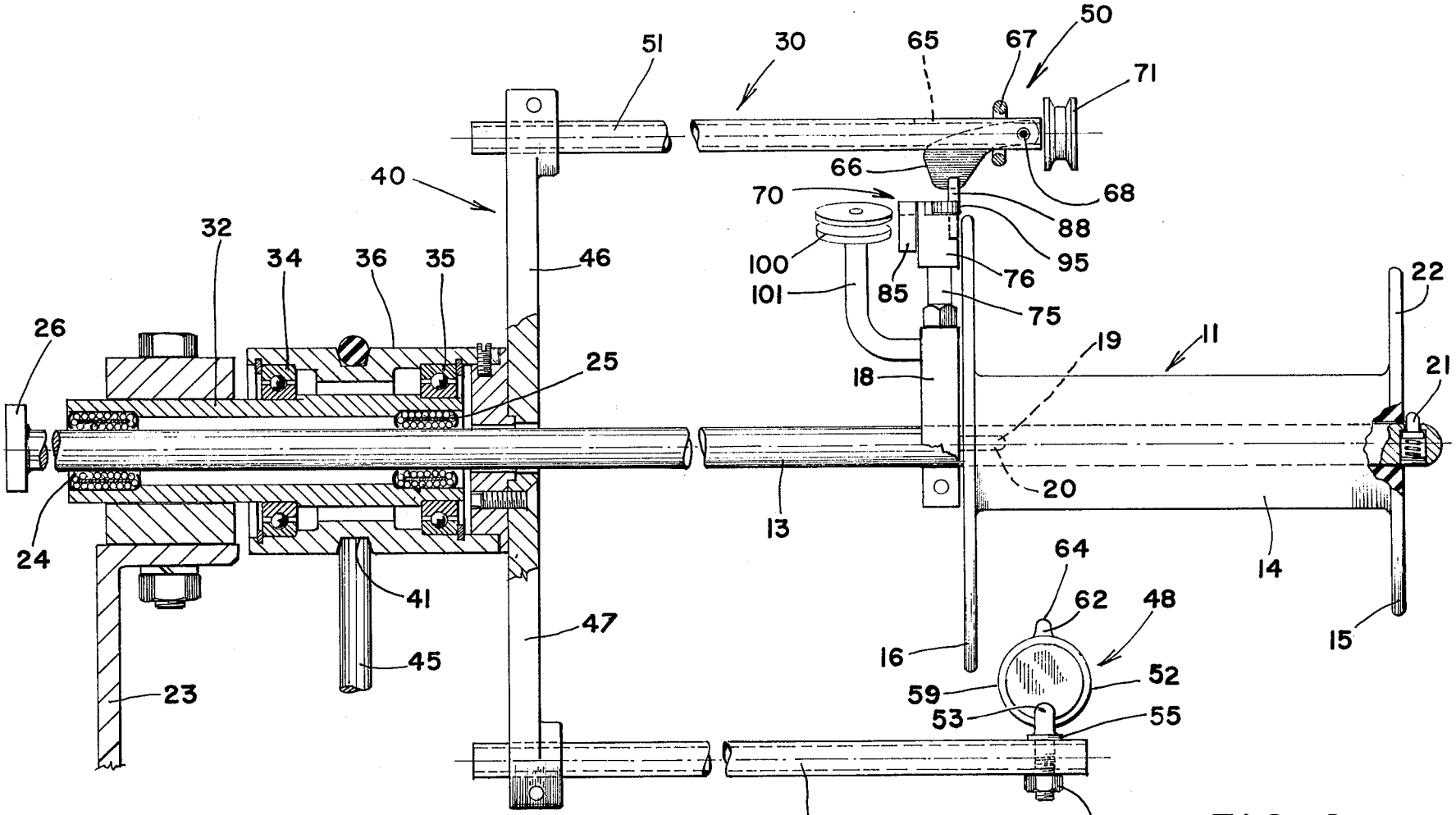
FIG. 2 is a longitudinal section through the apparatus depicted in FIG. 1 but with the flier rotated approximately 180° and with the spool extended.

The details of the counterweight/striker combination 50 presented from the second positioning rod 51 are more clearly apparent from FIG. 2. The outer extremity of the positioning rod 51 is bifurcated to provide an axial recess 65 within which a striker blade 66 is pivotally mounted on a pin 68. A biasing means is operatively connected between the striker blade 66 and the positioning rod 51 to assure that when the blade 66 protrudes radially inwardly with respect to the rod 51 (as depicted in FIGS. 1 and 2) it will not withdraw merely as a result of the centrifugal force created as the flier 40 is rotated by motor 43 and yet sufficiently free to pivot, as would be required were the hereinafter described cutting mechanism 70 to be aligned with a striker 66 such that axial reciprocation of the member on which the cutting mechanism 70 is mounted would bring a portion of the cutting mechanism into engagement with the striker during a time when the flier was not rotating. In that situation it is necessary for the striker to yield, which it does by the pivotal mounting arrangement, in order to preclude damage to either the striker or the cutting mechanism. In the embodiment depicted a resilient O-ring 67 provides the desired biasing action. It should be understood, however, that a metallic spring or other biasing means could be used with equal facility.

Also mounted on positioning rod 51 is a counterweight 71 which balances the weight differential between the pick-up and turning head 48 on rod 49 and the striker blade arrangement on rod 51 — a necessity to preclude deleterious imbalance vibrations that would otherwise result during the rotation of the flier 40 at operational speeds.

Figure 3:
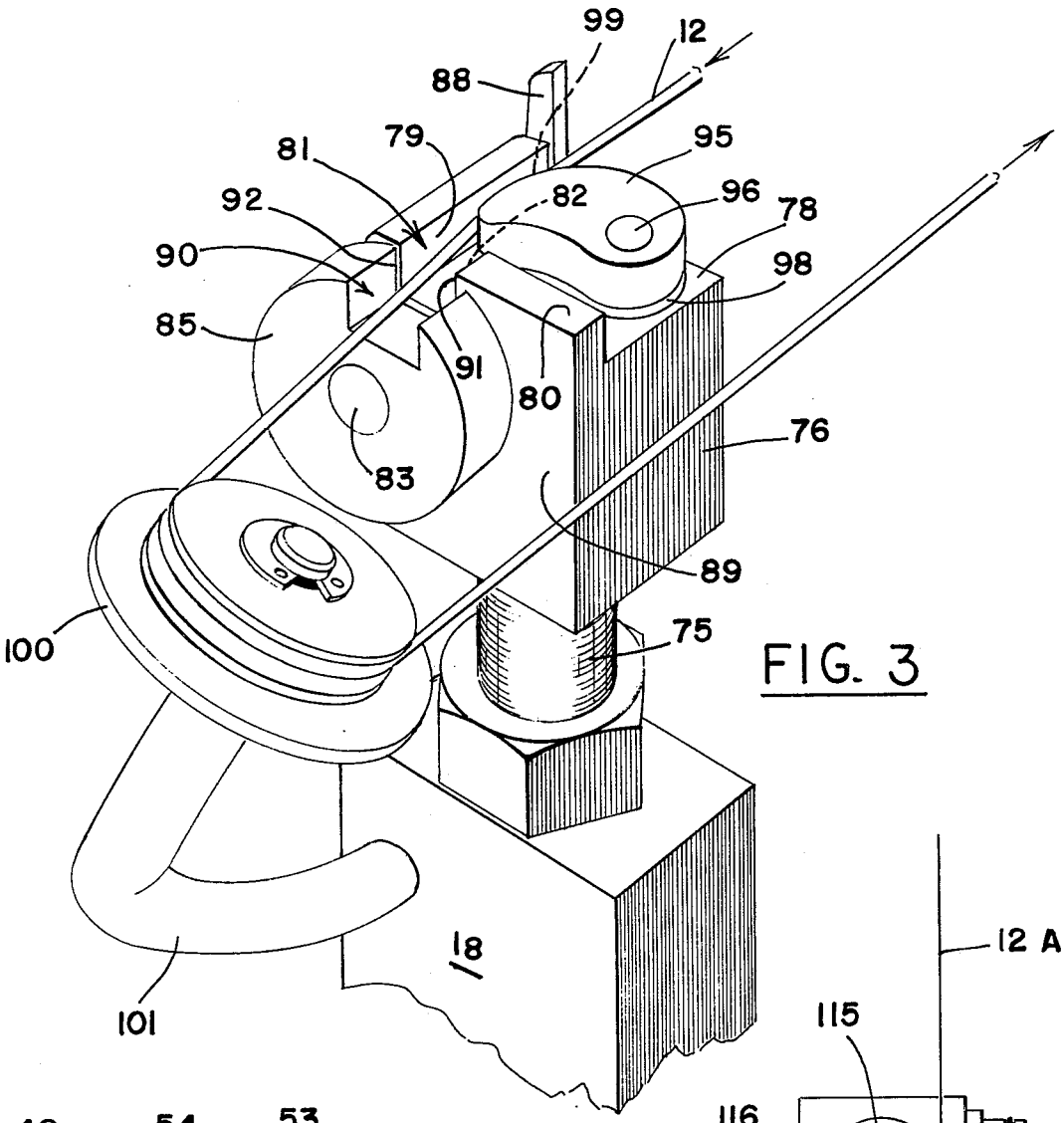
FIG. 3 is an enlarged area of FIG. 1 depicting the orienting pulley, the cutting mechanism and associated gripping means.

The aforementioned cutting mechanism 70 is presented from a radial post 75 that extends upwardly from the stop block 18, and, as best depicted in FIG. 3, is built around a body portion 76 the upwardly directed portion of which has a recessed ledge 78 bounded on one side by a vertical cleating face 79 and along the edge most remote from the spool 11 with a cutting shoulder 80. The cutting shoulder 80 and the cleating face 79 are disposed substantially at right angles but do not intersect — a passageway 81 being delineated between the cleating face 79 and the opposed face 82 on cutting shoulder 80. The passageway 81 must be of at least sufficient magnitude to allow facile positioning, and free passage, of the filament 12 therethrough.

A shaft 83 is journaled through the body portion 76. One end of the shaft 83 is affixed to a cutting disc 85, and the other end of the shaft 83 is affixed to a throw arm 88. The disc 85 is mounted to rotate against the rearwardly directed face 89 common to the body portion 76 and the cutting shoulder 80 in response to rotation of the shaft 83 effected by throw arm 88.

The disc 85 presents a radially directed aperture 90 that registers with the passageway 81 when the throw arm 88 is oriented to extend radially upwardly from the body portion 76. The intersection of the opposed face 82 and the rearwardly directed face 89 delineates a blade edge 91 on the cutting shoulder 80 which is opposed by a blade edge 92 along the aperture 90 in disc 85. As such, when the throw arm 88 is rotated (clockwise as viewed in FIG. 3) the movement of blade edge 92 on the disc 85 past the fixed blade edge 91 on shoulder 80 will sever the run of filament 12 which extends through the passageway 81 and the aperture 90.

A cam cleat 95 is pivotally mounted on the recessed ledge 78, as by pivot pin 96, and is biased, as by spring 98, to urge the cam surface 99 on cleat 95 into continuous engagement with the cleating face 79. However, the action of spring 98 must not be so vigorous as to restrict movement of the filament 12 in the direction of the arrows in FIGS. 1 and 3. The spring 98 must simply press the filament 12 against the cleating face 79 so that it will allow the thread to move in the direction of the arrows and yet allow attempted movement of the filament in a reverse direction frictionally to increase the pressure applied against the filament 12 by the opposed cleating face 79 and cam surface 99 and thereby preclude movement of the filament in a direction opposite to that indicated by the arrows.

Axially inboard with respect to the spool 11 and the cutting mechanism 70 is an orienting pulley 100 that is rotatably mounted on a sprindle 101 which may also be supported from the stop block 18.

Spaced axially outward with respect to the spool 11 is a lead-in pulley 102 (FIG. 1). The lead-in pulley 102 is mounted on a supporting spindle 103 and oriented to rotate about an axis 104 that is substantially perpendicular to the axis 105 of the spool 11.

The orienting pulley 100 is canted such that the feed run "A" of filament 12 between the lead-in pulley 102 and the orienting pulley 100 — which passes through the cutting mechanism 70 — is located radially outwardly of the tail run "B" between the same two pulleys 100 and 102. The reason for this disposition will become readily apparent from the following description as to the operation of the automatic anchoring, twisting and spooling apparatus.

Continuing to refer to FIG. 1, the box 110 represents the source of finished filament 12, and while there may be a plurality of ends emanating from the source, the representative single strand of filament 12 which extends from the source 110 to a waste roll 111 is sufficient to explain the operation of the present apparatus 10.

Because the apparatus 10 will impart a twist to each wrap of filament 12 wound onto the spool 11, the workman must determine from which end of the spool the filament will be stripped, and that end must be located as the outboard end when the spool is mounted on shaft 13. In that way the twist applied to the filament as it is wound onto the spool will nullify the twist induced as the filament is stripped axially from the spool. Were the spool reversed, the twisting of the filament would be compounded — the twist induced by stripping the line from the spool being added to the twist already imparted thereto during the winding operation.

In order to thread the subject apparatus 10 a workman loosely — so as to permit the thread to slide through his hand as it continues its relatively high speed run from the source 110 to the waste roll 111 — engages the thread, reeves it about the lead-in pulley 102, extends the lead-in run "A" through the registered passageway 81 and aperture 90 in the cutting mechanism 70 and passes the run "A" about the orienting pulley 100. From the orienting pulley, the tailing run "B" is returned about the lead-in pulley 102 and permitted to continue to the waste roll 111. This completes the threading of the apparatus 10 and is the only time the thread need be touched by hand.

After the apparatus 10 is threaded the workman actuates an "on" button (not shown) to start motor 43. The motor 43 rotates the flier 40 at a controlled speed compatible with the rate at which the filament leaves source 110 while the crosshead 26 reciprocates the spool 11. At such time as reciprocation of the spool 11 positions the pick-up and turning head 48 on the rotating flier 40 in axial proximity to the inboard flange 16 on the spool 11 (FIG. 2), the path of the lead-in run "A" intercepts the rotational path of the filament catcher 48. The filament slides along the finger 62 and conical section 61 and onto the turning sheave 60. Continued rotation of the flier 40 winds the filament 12 onto the spool 11 and brings the striker blade 66 into engagement with the throw arm 88, thereby rotating the cutting disc 85 sufficiently to sever the filament 12 between the blade edge 91 on shoulder 80 and the blade edge 92 on disc 85.

Upon severance of the filament 12 the tailing end "B" is wound onto the waste roll 111, and the lead-in run "A" continues to be wound onto the spool 11. It should be appreciated that as successive wraps of the filament 12 overlap any previous wrap the filament will thereby anchor itself to the spool. However, it cannot be assumed that the filament will always so anchor itself before the tail and lead-in runs are severed, and without being anchored to the spool there is no assurance that the filament will wind onto the spool. In order, therefore, to obviate the problems attendant upon failure of the filament immediately to anchor itself to the spool the present apparatus grips the severed end of the lead-in run "A" between the cam surface 99 on cleat 95 and the cleating face 79 to preclude withdrawal of the severed end and assure that rotation of the flier 40 will wind the filament 12 onto the spool 11.

It should now be apparent that the apparatus described to this point will automatically anchor and wind filament onto a spool. The subject apparatus does, in addition, apply a controlled twist to the filament by virtue of the fact that the filament approaches the spool from a point axially thereof —i.e., from the lead-in pulley 102 — and is thereupon wound onto the spool by a flier mechanism 40, the turning sheave 60 of which rotates concentrically about the spool. Because of this disposition, one turn, or twist, is imparted to the filament for each revolution of the flier 40.

It has been found, however, that whereas the filament is twisted by this configuration the twist is as likely to move into that portion of the filament leading back to the source 110 as it is to remain with that portion of the line being wound onto the spool. In order, therefore, to induce the twist onto the spool, means are preferably provided to preclude the twist from being transmitted across the lead-in pulley 102 toward the source 110. One such means is accomplished by reeving the filament 12 at least one complete turn about the lead-in pulley 102.

Figure 5:
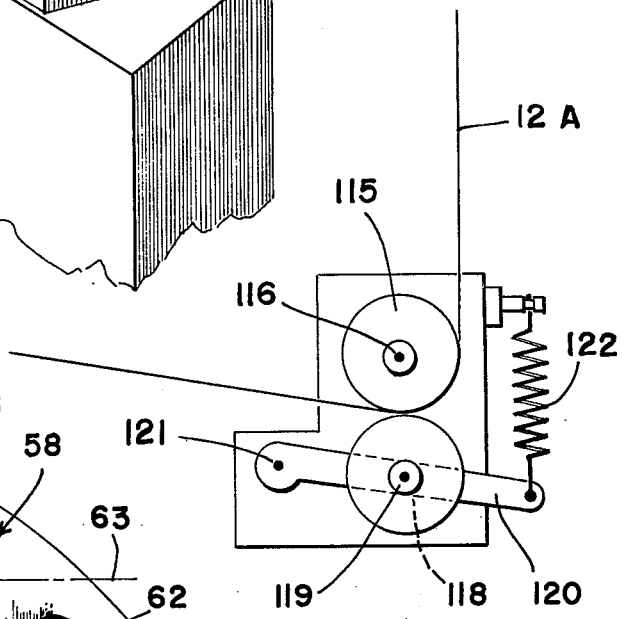

An alternative means is depicted in FIG. 5. The alternative arrangement employs a first roller 115 rotatably mounted on a fixed spindle 116. A second roller 118 is rotatably mounted on a spindle 119 presented from a swing arm 120, one end of which is mounted on pivot pin 121 and the other end of which is attached to a spring 122 by which the arm 120 is biased to urge the second roller 118 into continuous engagement with the first roller 115. If the feed run 12 "A" passes between the two rollers, the pressure applied thereagainst by the biasing action of spring 122 will preclude transmittal of a twist in the filament thereacross and yet the freely rotatable nature of the two rollers will not restrict passage of the filament itself to the winding mechanism.

It should, therefore, now be apparent that an apparatus embodying the concept of the present invention anchors, twists and winds filament onto a receiving spool automatically and otherwise accomplishes the objects of the invention.

We claim:

1. Filament spooling apparatus comprising:

a spool shaft;

a filament receiving spool non-rotatably mounted on said spool shaft for translational reciprocation;

a winding means disposed at least in part radially of said filament receiving spool including a flier having a hub, spacer arms extending outwardly of said hub in diametric opposition, a positioning rod mounted transversely of each said spacer arm to be disposed substantially parallel to said spool shaft, a pick-up and turning head carried on one said positioning arm and a counterweight mounted on the other of said positioning rods, said pick-up and turning head including a mounting plate secured to the positioning rod on which the pick-up and turning head is mounted, a thread catcher mounted in spaced relation with respect to said mounting plate and a sheave rotatably journaled between said mounting plate and said thread catcher; and means to rotate said winding means with respect to said filament receiving spool, said means to rotate being operatively connected to said hub.

2. Filament spooling apparatus, as set forth in claim 1, in which the thread catcher comprises a conical section, said conical section having an axis which extends outwardly from the winding sheave, said conical section terminating in a cylindrical finger which projects obliquely from the axis of said conical section.

3. Filament spooling apparatus, comprising:

a spool shaft;

a filament receiving spool mounted on and having an axis coincident with said spool shaft for translational reciprocation;

a lead-in pulley located axially outwardly of said receiving spool and mounted to rotate about an axis oriented substantially transversely with respect to the axis of said receiving spool;

a winding means disposed at least in part radially of said filament receiving spool;

means to effect relative rotation between said winding means and said filament receiving spool;

means provided in conjunction with said lead-in pulley to preclude any twist imparted to that portion of the filament extending from one side of said lead-in pulley from being transmitted to that portion of the filament extending from the other side of said lead-in pulley; and an orienting pulley presented in proximity to that end of the filament receiving spool axially opposite the lead-in pulley, a feed and a tailing run of filament extending between said lead-in and orienting pulleys, said orienting pulley being canted to effect selective engagement of said feed run by said winding means.

4. Filament spooling apparatus, as set forth in claim 3, in which cutting means are provided to sever the feed and tailing runs after a predetermined length of the feed run has been wound onto said receiving spool.

5. Filament spooling apparatus, as set forth in claim 3, in which cutting means are provided to sever the feed and tailing runs and in which means are provided to grip the severed end of the feed run at least sequentially after severance thereof from said tail run.

6. Filament spooling apparatus, as set forth in claim 3, in which means are provided axially to translate said receiving spool with respect to said winding means, a striker mechanism being carried on said winding means, said striker mechanism actuating said cutting means when said receiving spool has translated axially to a predetermined location with respect to said winding means.

7. Filament spooling apparatus, as set forth in claim 6, in which said striker comprises a blade pivotally mounted on said winding means with biasing means being provided to urge said pivotally mounted striker into a position to actuate said cutting means.

* * * * *